US005619753A

United States Patent [19]

Van Cort

[11] Patent Number: 5,619,753

[45] Date of Patent: Apr. 15, 1997

[54] REFLECTIVE NOVELTY MASK HAVING TRANSPARENT STRIPS

[75] Inventor: Lawrence E. Van Cort, Conway, Mass.

[73] Assignee: Van Cort Instruments, Inc., Northampton, Mass.

[21] Appl. No.: 467,220

[22] Filed: Jun. 6, 1995

[51] Int. Cl.[6] ..... A42B 1/24

[52] U.S. Cl. ..... 2/206; 2/209.14; 359/880

[58] Field of Search ..... 2/9, 424, 173, 2/209.14, 206; 28/64.1, 64.5, 64.2, 64.3, 64.6, 64.7; 434/371; 40/900; 132/102, 291, 316; 248/549, 466; 359/838, 850, 872, 879, 880

[56] References Cited

U.S. PATENT DOCUMENTS

| | | | |
|---|---|---|---|
| D. 143,655 | 1/1946 | Friedman | D28/64.1 |
| D. 205,272 | 7/1966 | Joseph | D28/64.5 |
| 1,979,119 | 10/1934 | Radzinsky | 434/371 |
| 2,914,772 | 12/1959 | Lemelson | 2/173 |
| 2,964,757 | 12/1960 | Jarvis | 2/173 |
| 3,210,884 | 10/1965 | Sharff et al. . | |
| 3,729,865 | 5/1973 | Naunheim . | |
| 3,861,078 | 1/1975 | Snyder . | |
| 4,232,476 | 11/1980 | Lieberman . | |
| 4,273,418 | 6/1981 | Gillespie et al. | 350/289 |
| 4,365,798 | 12/1982 | Shields et al. | 2/173 |

*Primary Examiner*—C. D. Crowder
*Assistant Examiner*—Larry D. Worrell, Jr.
*Attorney, Agent, or Firm*—Fishman, Dionne & Cantor

[57] ABSTRACT

A reflective novelty mask is presented. The mask has somewhat of an oval shape, more specifically the mask has a shape which roughly follows the contour of a human face. Alternating horizontal reflective and transparent strips of about equal width are defined within an outer frame. A variety of accessories are provided to be attached to mask. By way of example animal shape parts may be employed as the accessories. Also, the accessories may include accessories for famous people as well as for objects (e.g., a tree). A clip is also provided to allow a user to customizes and created their own accessories.

33 Claims, 6 Drawing Sheets

REFLECTIVE NOVELTY MASK HAVING TRANSPARENT STRIPS

BACKGROUND OF THE INVENTION

The present invention relates to novelty masks. More specifically, the present invention relates to reflective novelty masks with a variety of mask accessories.

Novelty type reflective devices are known. By way of example, U.S. Pat. Nos. 4,273,418 and 4,365,798 disclose such devices. U.S. Pat. No. 4,273,418 discloses a rotating circular disk having alternating transparent and reflective areas according to predetermined patterns. The total reflective area is approximately equal the total transparent area. This disc is rotated by an electric motor at a selected speed, whereby a transmitted image of an object on the opposite side of the disc is superimposed upon the reflected image of the user with the two images merging to form an optical illusion. U.S. Pat. No. 4,365,798 discloses a novelty mirror which has three horizontally aligned and equally spaced holes in the upper portion with the farthest spaced holes being space approximately the distance between the eyes of one of the users. The mirror is held with the holes aligned the eyes of a person on the other side of the device, the viewer's face is seen with the eyes of the person on the other side. Both sides of the device may be a mirror, whereby this transposition of eye features occurs simultaneously for both viewers.

SUMMARY OF THE INVENTION

The above-discussed and other drawbacks and deficiencies of the prior art are overcome or alleviated by the reflective novelty mask of the present invention. In accordance with the present invention, the mask has somewhat of an oval shape, more specifically the mask has a shape which roughly follows the contour of a human face. Alternating horizontal reflective and transparent strips of about equal width are defined within an outer frame.

In accordance with the present invention, a variety of accessories are provided to be attached to mask. By way of example animal shape parts may be employed as the accessories. Also, the accessories may include accessories for famous people as well as for objects (e.g., a tree). A clip is also provided to allow a user to customizes and created their own accessories.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DESCRIPTION OF THE PREFERRED EMBODIMENT

Figure 1:
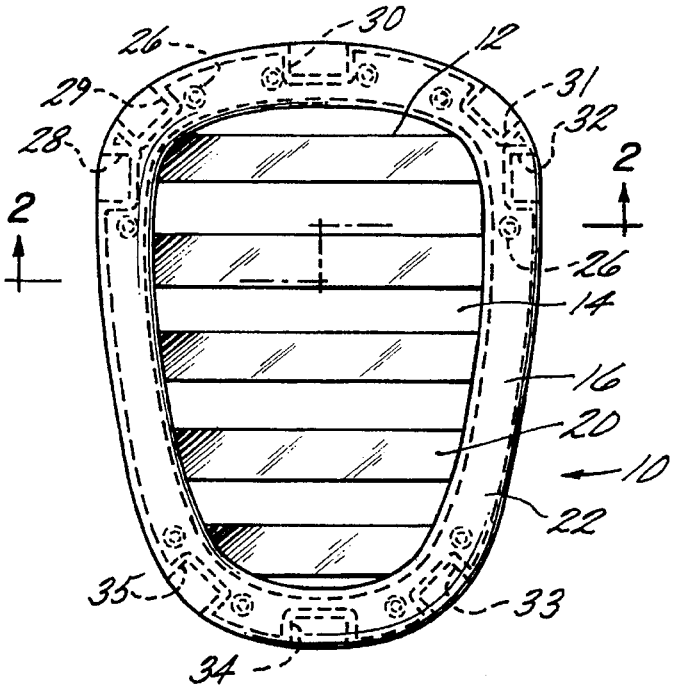
FIG. 1 is a front view of the reflective novelty mask in accordance with the present invention.
Figure 2:
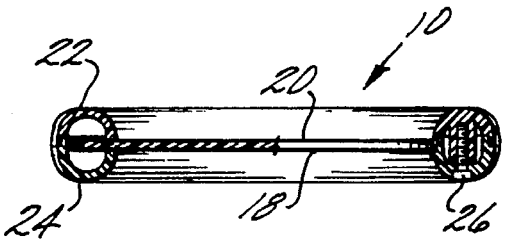
FIG. 2 is a cross section view through the line 2—2 in FIG. 1.
Figure 3:
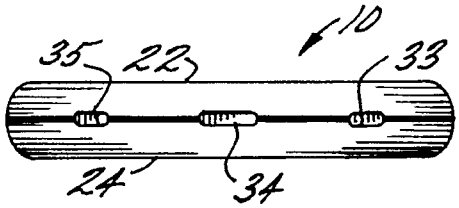
FIG. 3 is a bottom view of the reflective novelty mask of FIG. 1.

Referring to FIGS. 1–3 a reflective novelty mask in accordance with the present invention is generally shown at 10. Mask 10 has somewhat of an oval shape, more specifically mask 10 has a shape which roughly follows the contour of a human face. Alternating horizontal reflective and transparent strips 12 and 14, respectively, of about equal width are defined within an outer frame 16. Reflective strips 14 are preferably reflective at surfaces 18 and 20 thereof. Further, reflective strips 14 can be comprised of a plurality of discrete strips spaced apart are retained thereat by frame 16 with transparent strips 12 being defined by openings therebetween. Also, transparent strips 12 could be formed by a plurality of discrete strips of transparent material disposed therebetween. Moreover, strips 12 and 14 could be formed from a single continuous piece, e.g., a transparent material having reflective strips deposited thereon.

Frame 16 comprises two cooperating frame halves 22 and 24 which are held together and thereby support the strips by a plurality of screws 26 or other type of fastener, e.g., snap locking connections integral with the frame. Frame 16 cross sectionally has generally a C-shape. Each frame half 22 and 24 includes a plurality of notches that cooperate to define openings 28–35 at the outer periphery of frame 16 for the attachment of accessories, as will be described hereinbelow.

Figure 4:
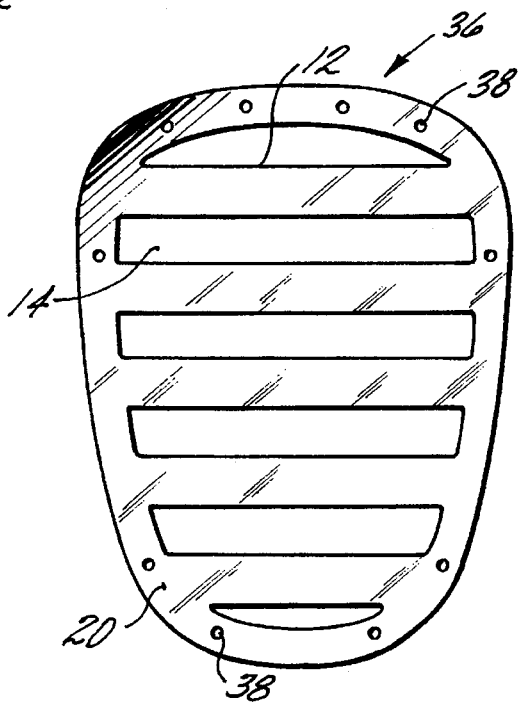
FIG. 4 is a front view of a reflective member of the reflective novelty mask of FIG. 1.

Referring to FIG. 4, in accordance with a preferred embodiment, a member 36 is used to provide the alternating reflective and transparent strips. Member 36 has somewhat of an oval shape, more specifically member 36 has a shape which roughly follows the contour of a human face. Member 36 includes a plurality of openings 38 about the periphery thereof which allow screws 26 to pass therethrough for retaining member 36 between frame halves 22 and 24. Transparent strips 12 are preferably formed by openings through member 36. Alternatively, member 36 may be comprised of a transparent material with reflective strips deposited thereon.

Reflective surfaces may be comprised of a highly polished metal, glass or plastic mirror, or other suitable reflective material. Transparent surfaces, when not comprised of openings, may be comprised of optical quality plastic or glass. However, since this is a novelty device and will likely be used by children, it is preferred that glass and other breakable material not be employed. Further, all edges are to be rounded so that no sharp are gaged edges are exposed. The frame is preferably comprised of a suitable plastic which is molded to the desired shape and is available in a variety of colors. Alternatively, the frame may be comprised of wood or other suitable material.

Figure 5:
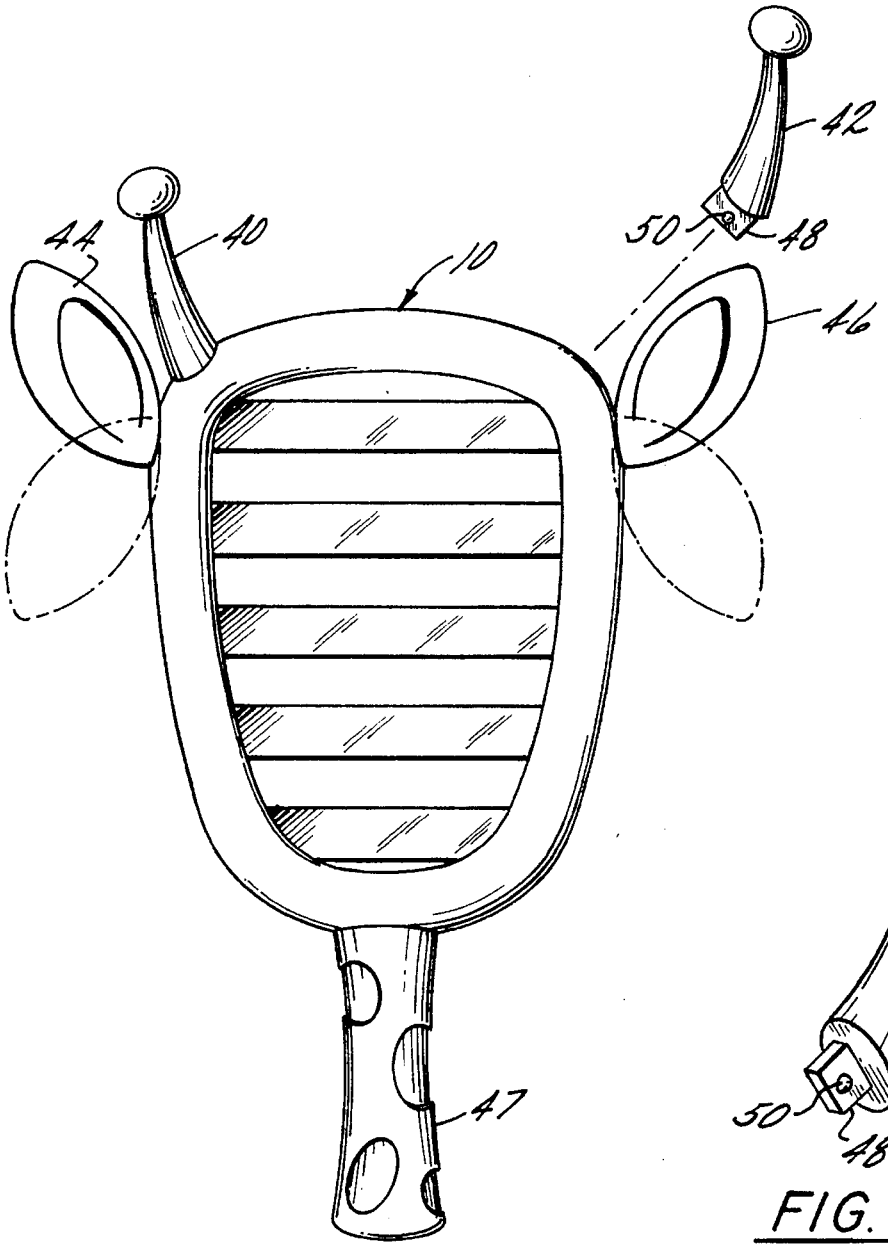
FIG. 5 is a from view of reflective novelty mask of FIG. 1 with giraffe accessories, with a portion thereof exploded, and an alternate embodiment thereof in phantom.
Figure 5A:
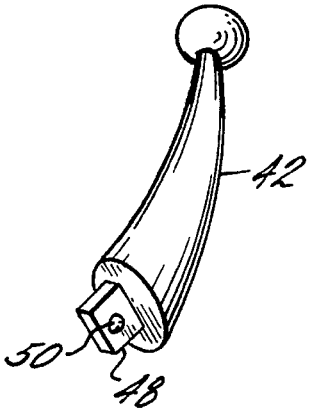
FIG. 5A is a perspective view of the antlers of FIG. 5.

In accordance with the present invention, a variety of accessories are provided to be attached to mask 10. Referring to FIGS. 5 and 5A, giraffe horns 40 and 42 are retained in openings 29 and 31, respectively; giraffe ears 44 and 46 are retained in openings 28 and 32, respectively; and a giraffe neck 47 is retained in opening 34. Neck 47 also functions as a handle for mask 10. Each of the above described accessories includes a tab 48 as shown on horn 42 which is of a size and shape suitable for insertion into the opening. It will be appreciated that each of the aforementioned openings are the same size and shape for accepting various accessories. Protrusions 50 depend from opposing sides of tab 48 to allow snap locking insertion and removal of the accessory. Further, ears 44 and 46 can be drooped has shown in phantom in the FIGURE.

Figure 6:
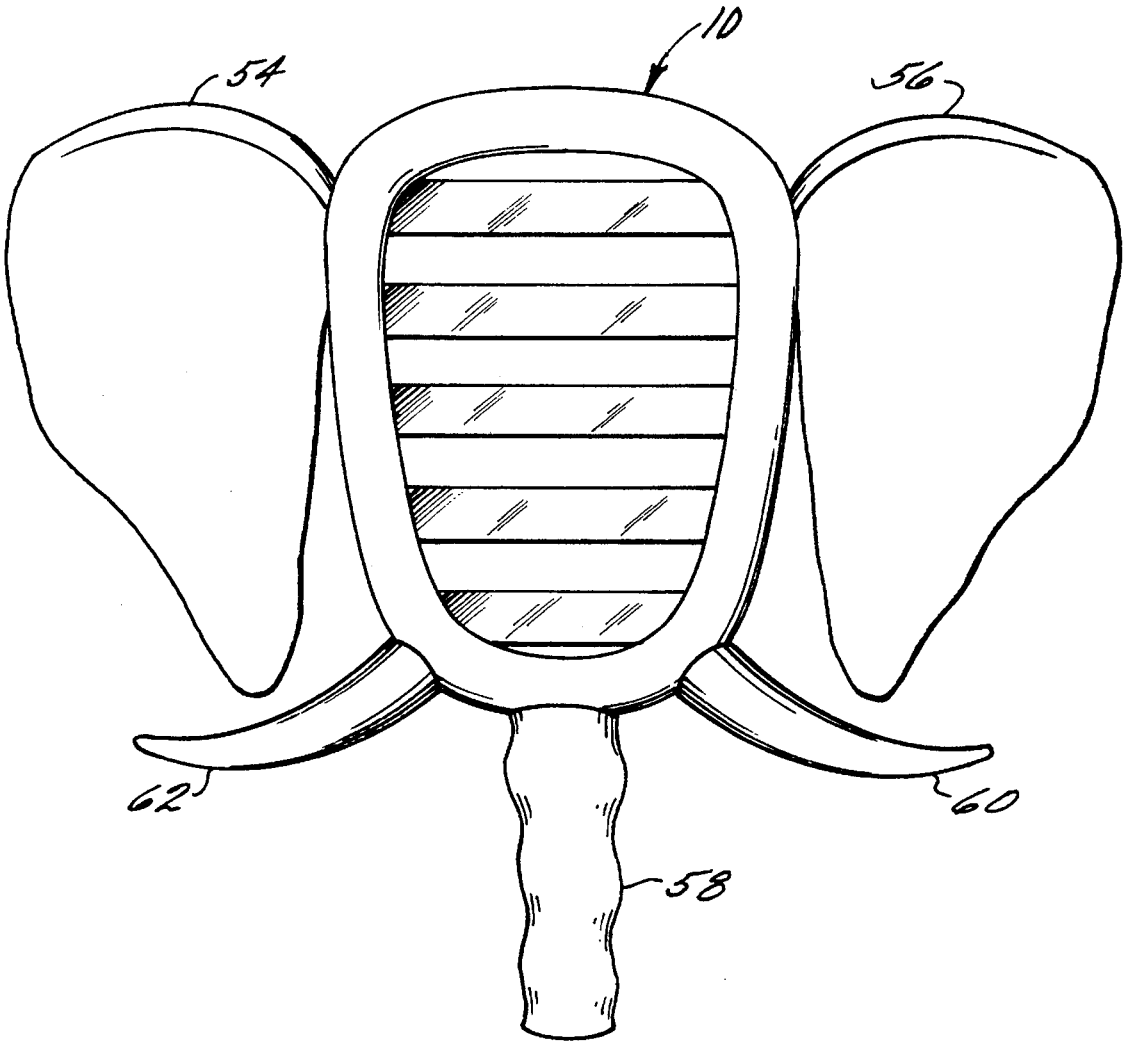
FIG. 6 is a front view of reflective novelty mask of FIG. 1 with elephant accessories.

Referring to FIG. 6, elephant ears 54 and 56 are retained in openings 28 and 32, respectively; an elephant trunk 58 is retained in opening 34; and elephant tusk 60 and 62 are retained in openings 33 and 35 respectively. Trunk 58 also functions as a handle for mask 10. Each of the above described accessories includes a tab 48 with protrusions 50 as described hereinbefore.

Figure 7:
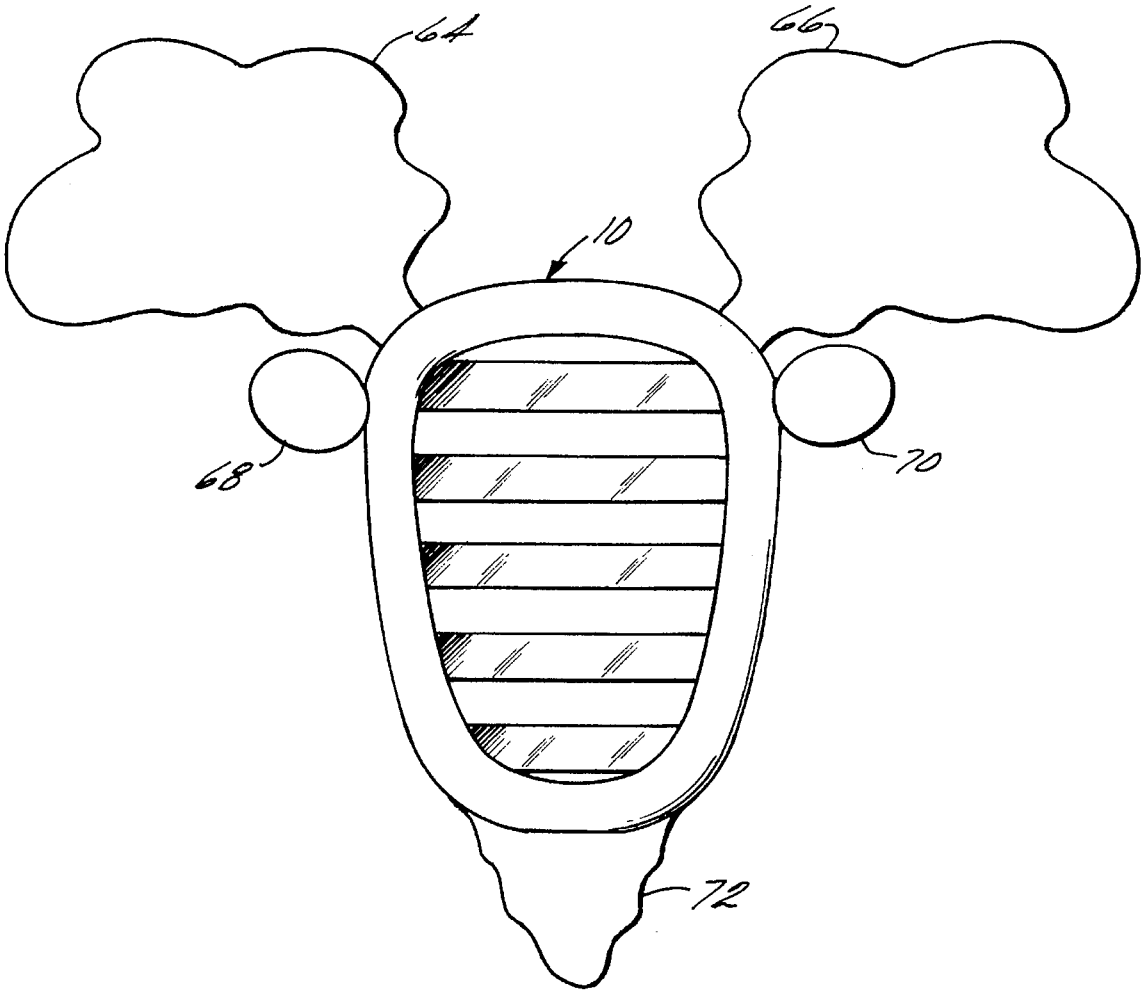
FIG. 7 is a front view of reflective novelty mask of FIG. 1 with moose accessories.

Referring to FIG. 7, moose antlers 64 and 66 are retained in openings 29 and 31, respectively; moose ears 68 and 70 are retained in openings 28 and 32, respectively; and a moose beard 72 is retained in opening 34. Each of the above described accessories includes a tab 48 with protrusions 50 as described hereinbefore.

Figure 8:
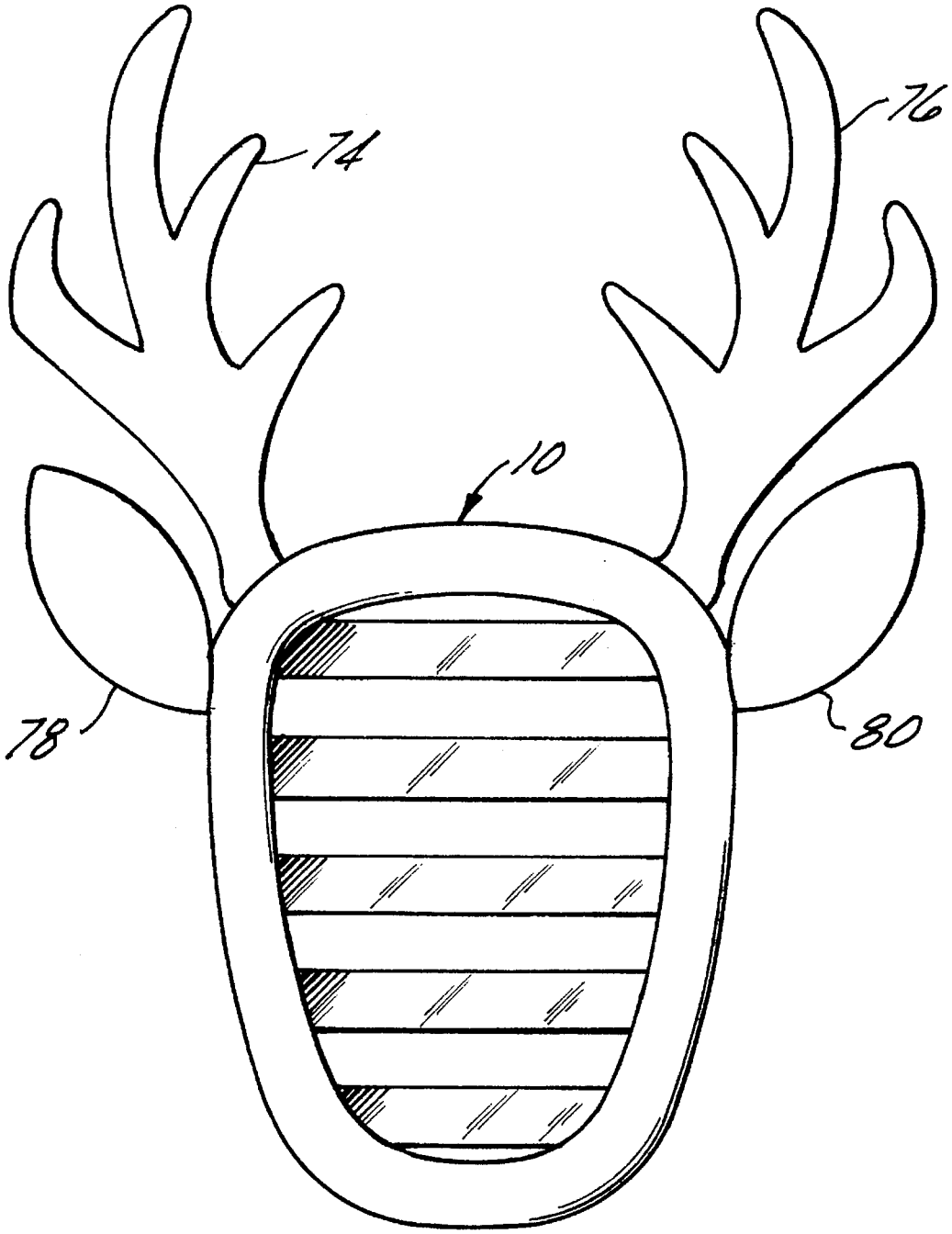
FIG. 8 is a front view of reflective novelty mask of FIG. 1 with deer accessories.

Referring to FIG. 8, deer antlers 74 and 76 are retained in openings 29 and 31, respectively, and deer ears 78 and 80 are retained in openings 28 and 32, respectively. Each of the above described accessories includes a tab 48 with protrusions 50 as described hereinbefore.

Figure 9:
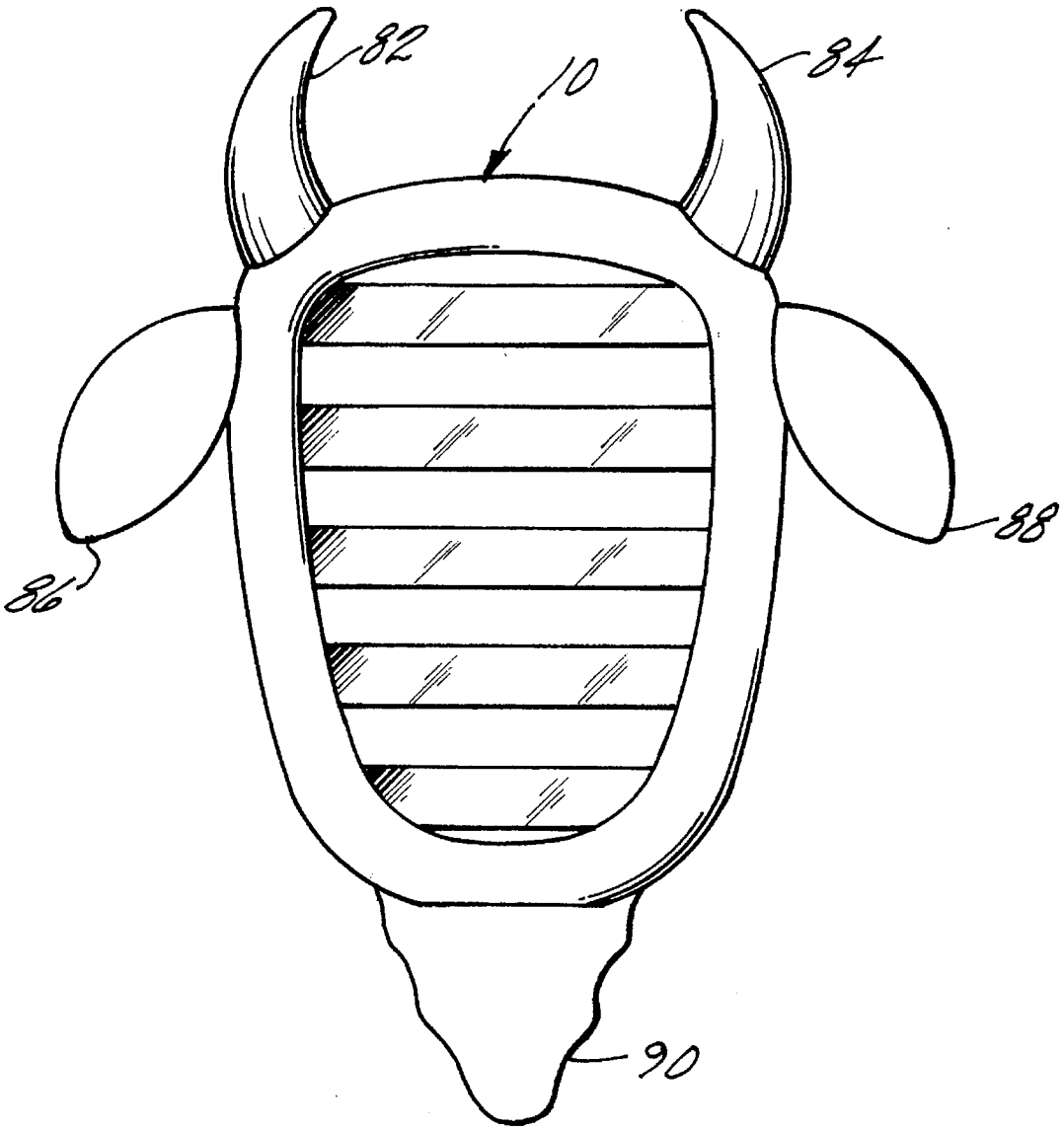
FIG. 9 is a front view of reflective novelty mask of FIG. 1 with buffalo accessories.

Referring to FIG. 9, buffalo horns 82 and 84 are retained in openings 29 and 31, respectively; buffalo ears 86 and 88 are retained in openings 28 and 32, respectively; and a buffalo beard 90 is retained in opening 34. Each of the above described accessories includes a tab 48 with protrusions 50 as described hereinbefore.

It will be appreciated that the above is only exemplary and is not intended to be a complete listing of possible accessories that can be used with the mask of the present invention. Further, while all of the above examples have been directed to animals, the mask of the present invention is not limited to such as the accessories may include accessories for famous people as well as for objects (e.g., a tree).

Figure 10:
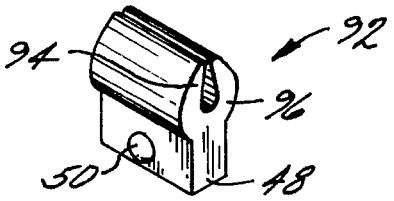
FIG. 10 is a perspective view of a clip for use with accessories on the reflective novelty mask of FIG. 1.

Referring to FIG. 10, a clip 92 is provided to allow a user to customizes and created their own accessories. Clip 92 comprises a pair of resilient arms 94, 96 which cooperate to retain an accessory. Tab 48 depends from arms 94, 96 and includes protrusions 50, as described hereinbefore.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A reflective novelty mask comprising:

a frame defining a framed area;

a plurality of reflective strip areas supported by said frame and extending substantially across said framed area; and a plurality of transparent strip areas interposed in an alternating fashion with said reflective strip areas.

2. The mask of claim 1 wherein said frame has a shape which roughly follows the contour of a human face.

3. The mask of claim 1 further comprising:

a plurality of spaced apart openings in said frame, about the periphery thereof.

4. The mask of claim 1 further comprising:

a plurality of accessories attached to said frame.

5. The mask of claim 3 further comprising:

a plurality of accessories attached to said frame by insertion of one end of each of said accessories into a corresponding said opening in said frame.

6. The mask of claim 1 wherein:

said reflective strip areas each comprise a member having at least one reflective surface, said member being supported in said frame at opposing ends thereof.

7. The mask of claim 6 wherein:

said transparent strip areas comprise spaces interposed in an alternating fashion with said members.

8. The mask of claim 6 wherein:

said transparent strip areas each comprise a transparent member, said transparent member being supported in said frame at opposing ends thereof, said transparent members interposed in an alternating fashion with said members having said at least one reflective surface.

9. The mask of claim 1 wherein said reflective strip areas and said transparent strip areas are strip areas in the horizontal direction when said mask is in an upright position.

10. The mask of claim 1 wherein:

said reflective strip areas comprise a plurality of reflective strips deposited on a transparent member supported in said frame; and said transparent strip areas are the areas of said transparent member between said reflective strips.

11. The mask of claim 1 wherein:

said reflective strip areas comprise a plurality of strip portions of a reflective member supported in said frame; and said transparent strip areas are open areas in said reflective member between said strip portions.

12. The mask of claim 4 wherein said accessories comprise giraffe horns, ears and a neck.

13. The mask of claim 5 wherein said accessories each include:

a tab depending from said end of accessory, said tap inserted into said corresponding opening in said frame; and a pair of protrusions depend from opposing sides of said tab to allow snap locking insertion and removal of said accessory.

14. The mask of claim 4 wherein said accessories comprise elephant ears, a trunk and tusks.

15. The mask of claim 4 wherein said accessories comprise moose antlers, ears and a beard.

16. The mask of claim 4 wherein said accessories comprise deer antlers and ears.

17. The mask of claim 4 wherein said accessories comprise buffalo horns, ears and a beard.

18. The mask of claim 1 further comprising:

a clip for attachment to said frame, said clip for retaining an accessory.

19. A reflective novelty mask comprising:

a frame defining a framed area, said frame having a shape which roughly follows the contour of a human face;

a plurality of accessories attached to said frame;

a plurality of reflective strip areas supported by said frame and extending substantially across said framed area; and a plurality of transparent strip areas interposed in an alternating fashion with said reflective strip areas.

20. The mask of claim 19 wherein said accessories are attached to said frame by insertion of one end of each of said accessories into a corresponding opening in said frame.

21. The mask of claim 19 wherein:

said reflective strip areas each comprise a member having at least one reflective surface, said member being supported in said frame at opposing ends thereof.

22. The mask of claim 21 wherein:

said transparent strip areas comprise spaces interposed in an alternating fashion with said members.

23. The mask of claim 21 wherein:

said transparent strip areas each comprise a transparent member, said transparent member being supported in said frame at opposing ends thereof, said transparent members interposed in an alternating fashion with said members having said at least one reflective surface.

24. The mask of claim 19 wherein said reflective strip areas and said transparent strip areas are strip areas in the horizontal direction when said mask is in an upright position.

25. The mask of claim 19 wherein:

said reflective strip areas comprise a plurality of reflective strips deposited on a transparent member supported in said frame; and said transparent strip areas are the areas of said transparent member between said reflective strips.

26. The mask of claim 19 wherein:

said reflective strip areas comprise a plurality of strip portions of a reflective member supported in said frame; and said transparent strip areas are open areas in said reflective member between said strip portions.

27. The mask of claim 19 wherein said accessories comprise giraffe horns, ears and a neck.

28. The mask of claim 20 wherein said accessories each include:

a tab depending from said end of accessory, said tap inserted into said corresponding opening in said frame; and a pair of protrusions depend from opposing sides of said tab to allow snap locking insertion and removal of said accessory.

29. The mask of claim 19 wherein said accessories comprise elephant ears, a trunk and tusks.

30. The mask of claim 19 wherein said accessories comprise moose antlers, ears and a beard.

31. The mask of claim 19 wherein said accessories comprise deer antlers and ears.

32. The mask of claim 19 wherein said accessories comprise buffalo horns, ears and a beard.

33. The mask of claim 19 further comprising: a clip for attachment to said frame, said clip for retaining an accessory.

* * * * *